US007200241B2

(12) United States Patent
Fukuyama et al.

(10) Patent No.: US 7,200,241 B2
(45) Date of Patent: Apr. 3, 2007

(54) LOUDSPEAKER

(75) Inventors: Takanori Fukuyama, Mie (JP); Shuhei Konishi, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 450 days.

(21) Appl. No.: 10/480,931

(22) PCT Filed: Nov. 28, 2002

(86) PCT No.: PCT/JP02/12428

§ 371 (c)(1),
(2), (4) Date: Dec. 16, 2003

(87) PCT Pub. No.: WO2004/049751

PCT Pub. Date: Jun. 10, 2004

(65) Prior Publication Data

US 2004/0218779 A1 Nov. 4, 2004

(51) Int. Cl.
*H04R 25/00* (2006.01)

(52) U.S. Cl. ..... 381/407; 381/409; 381/410; 381/412

(58) Field of Classification Search ..... 381/396, 381/400, 409, 410, 412, 414, 423, 431, 152, 381/398, 401, 403, 404, 407, 419, 420, 424, 381/171, 172

See application file for complete search history.

(56) References Cited

U.S. PATENT DOCUMENTS 6,594,372 B2 * 7/2003 Nakaso ..... 381/396
6,956,953 B2 * 10/2005 Mazarakis ..... 381/152

FOREIGN PATENT DOCUMENTS

| | | |
|---|---|---|
| JP | 09-139997 | 5/1997 |
| JP | 10-094090 | 4/1998 |
| KR | 20-0287519 | 8/2002 |
| WO | 98/38832 | 9/1998 |

* cited by examiner

*Primary Examiner*—Huyen Le
(74) *Attorney, Agent, or Firm*—Wenderoth, Lind & Ponack, L.L.P.

(57) ABSTRACT

A speaker includes a substantially rectangular case having connection terminals at corners, a substantially rectangular voice coil, a diaphragm, and a substantially rectangular magnetic circuit. A lead drawn out from a corner of the voice coil in proximity to one of the connection terminals extends to the vicinity of another corner on a shorter side of the voice coil. The lead is bent, and then is connected to the connection terminal. This configuration can provide a speaker for use in portable equipment, such as a portable telephone, that can meet the requirements of space reduction without impairing characteristics, such as sound quality and sound pressure, and has excellent connection reliability of the terminal and reduced cost.

19 Claims, 8 Drawing Sheets

LOUDSPEAKER

FIELD OF THE INVENTION

The present invention relates to a loudspeaker (hereinafter referred to as a "speaker") used mainly in portable electronic equipment, such as a portable telephone.

BACKGROUND OF THE INVENTION

FIG. 12 is an exploded perspective view of a speaker used as a "receiver" for a conventional portable telephone. For a conventional speaker, a diaphragm, vibration system, and magnetic circuit are shaped substantially circular, as shown in FIG. 12.

The speaker shown in FIG. 12 comprises cylindrical yoke 1 having magnet 2 attached to a bottom thereof, top plate 3 bonded on the magnet 2, diaphragm 6 having voice coil 6*a* attached thereto, protector 10, damping cloth 10*a* covering sound holes of the protector 10, and resin case 7. The protector 10 and the damping cloth 10*a* protect the diaphragm 6 from a force applied from outside and restrict excessive amplitudes of the diaphragm 6 at resonance.

An inner wall of the cylindrical yoke 1 and the top plate 3 form a ring-shape magnetic gap (not shown). The yoke 1, the magnet 2, and the top plate 3 form a magnetic circuit 4. The magnetic circuit 4 is integrated into the case 7 by an insert molding, a fitting, a bonding, or other method. The case 7 further has insert-molded external connection terminals 8 and internal connection terminals (not shown) connected to the external connection terminals. To the internal connection terminals, leads drawn out from the voice coil 6*a* are connected.

The outer periphery of the diaphragm 6 is bonded to case 7 by adhesive material, with the voice coil 6*a* inserted into the magnetic gap in the magnetic circuit 4.

In the speaker structured as above, sound signals are fed into the voice coil 6*a* via the external connection terminals 8 and the internal connection terminals and drive the voice coil 6*a* vertically and vibrate the diaphragm 6, thereby producing sound. According to one of the mounting methods of the speaker, each terminal 8 is formed of a spring material or the like and spring pressure produced by bent portion 8*a* of the spring material brings terminal 8 into contact with the power supply section of the equipment, as shown in FIG. 13.

In recent years, with a demand of a more multi-functional portable telephone, a larger display has been designed, and thus a saving in receiver space, i.e. a much smaller-sized speaker has been required. However, for a production of the smaller-sized speaker, a more precise assembling technique is required and stabilizing its quality is difficult. In addition, the smaller area of the diaphragm poses a problem of deterioration of sound quality and decrease in sound pressure of the speaker.

For an installation in a smaller space, a rectangular speaker is more effective than a circular speaker. However, a conventional rectangular speaker for use in a television set or the like, as described in the Japanese Patent Laid-Open Publication No. H10-94090, for example, cannot be downsized, using the same structure and materials.

The major reason is the dimension of the speaker. A receiver for use in a portable telephone measures, for example, 1.5 cm in length, 0.6 cm in width, and 0.25 cm in thickness. For these dimensions, conventional flexible wires for connecting the internal connection terminals and the voice coil cannot be used. In other words, the flexible wires must have a specific diameter large enough to cope with the amplitudes of the diaphragm. It is difficult to produce a flexible wire suitable for the dimensions required for the portable telephones or other portable electronic equipment. Also in a conventional circular speaker, wires for connecting the internal connection terminals and the voice coil are so short that excessive force applied thereto may break the wires.

Furthermore, in a case where the terminal 8 is brought into contact with the power supply section using spring pressure, excess bending of the bent portion 8*a* of the spring exceeds the reversible threshold of the spring of the terminal 8, when a value of the dimension at which the speaker is inserted into the equipment is set to a large value. In this case, the decreased spring pressure of terminal 8 results in unstable contact between the terminal and the power supply section. This unstable contact has a problem in that shocks or vibrations applied to the equipment may cause a contact failure and interrupt signals.

The present invention provides a small and rectangular speaker suitable for a portable electronic equipment that addresses the problems described above.

SUMMARY OF THE INVENTION

A speaker of the present invention comprises: a substantially rectangular case having connection terminals at corners thereof; a substantially rectangular voice coil having both ends electrically connected to the connection terminals; a diaphragm joined to the voice coil and attached to the case; and a substantially rectangular magnetic circuit fitted to the case. The magnetic circuit comprises a yoke, a magnet, and a plate, and further includes a magnetic gap. The speaker of the present invention is characterized in that a lead drawn from a corner of the voice coil in proximity to one of the connection terminals extends to a vicinity of another corner on a shorter side of the voice coil. The lead is bent, and then connected to the connection terminal. The speaker of the present invention is further characterized in that a range in which the lead extends is within a length of the shorter side of the coil and a difference in height in an axial direction of the voice coil is provided between a height of the lead draw-out portion of the voice coil and a height of the connection terminals.

BRIEF DESCRIPTION OF THE DRAWINGS

FIG. 1(*b*) is a perspective view of a case of FIG. 1 (*a*) seen from the bottom thereof.

DESCRIPTION OF THE PREFERRED EMBODIMENTS

Exemplary embodiments of the speakers in accordance with the present invention are described hereinafter with reference to the accompanying drawings.

First Exemplary Embodiment

Figure 1A:
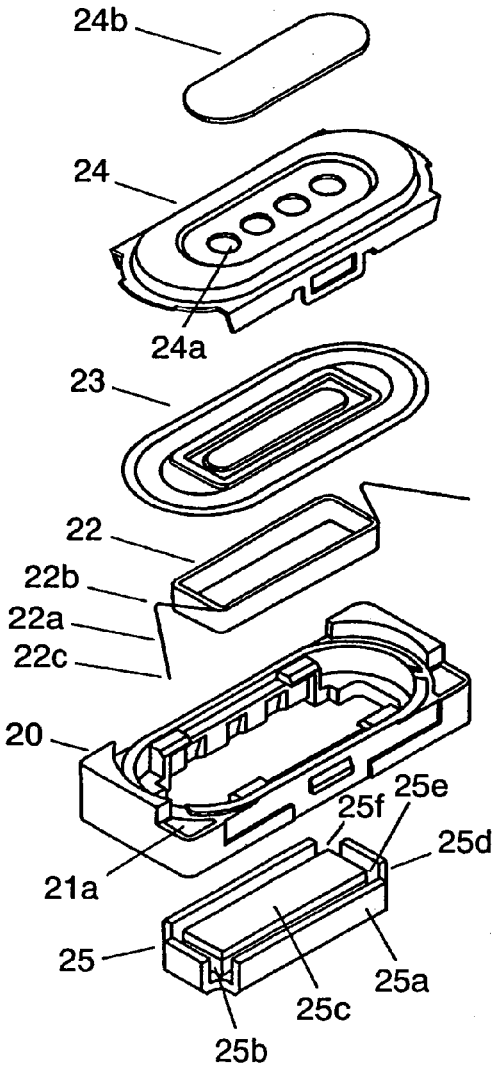
FIG. 1 (*a*) is an exploded perspective view of a speaker in accordance with a first exemplary embodiment of the present invention.
Figure 1B:
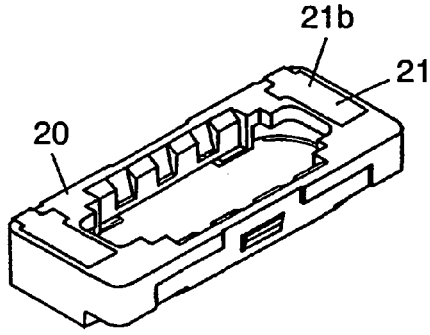

A speaker of the first exemplary embodiment of the present invention is described using FIGS. 1 (*a*) through 8. With reference to FIGS. 1 (*a*) and 1(*b*), terminals 21 are integrally formed by insert molding at both edges of substantially rectangular case 20 formed by resin molding. In each terminal, one end is exposed on the case to form internal contact 21*a* and the other end is exposed to form external contact 21*b*. The contacts 21*a* are disposed at corners of the case 20. The top face of each contact 21*a* is soldered as required, to secure reliability of electrical connection to lead 22*a* drawn out from voice coil 22.

Figure 2:
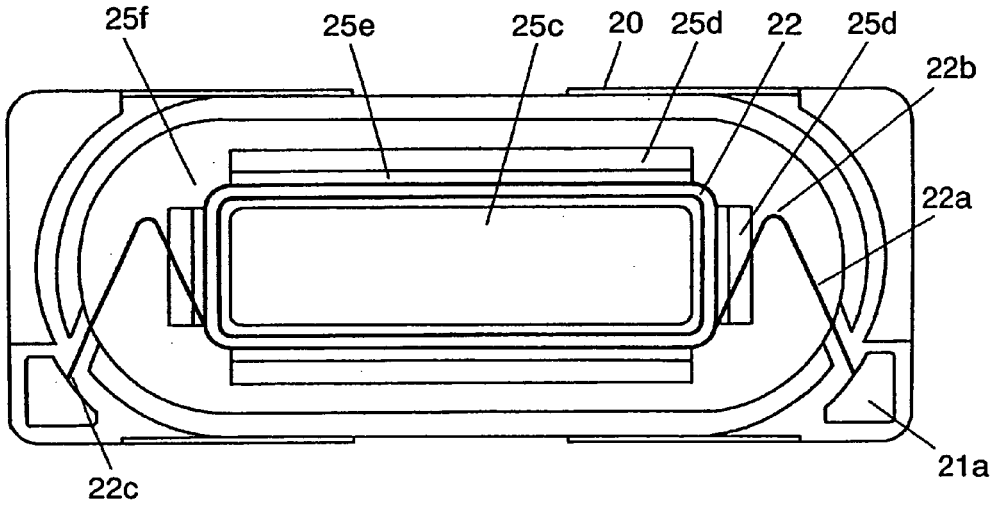
FIG. 2 is a top view illustrating a positional relation between the case and a voice coil of the speaker of the present invention.

As shown in FIG. 2, substantially rectangular voice coil 22 disposed in the case 20 has the leads 22*a* drawn from corners of the body of the voice coil 22 and each lead 22*a* is connected to the contact 21*a*. Each lead 22*a* is drawn out from a lead draw-out portion to a direction of the opposed corner, then, the lead 22*a* is bent into an L-shape or U-shape at bent portion 22*b* and end 22*c* of the lead 22*a* is soldered to the contact 21*a*.

As described above, in the present embodiment, the lead 22*a* extends from a corner, and is bent at the bent portion 22*b* and connects to the contact 21*a*. Therefore, a length of the lead 22*a* becomes long. This structure provides the lead 22*a* with a tolerance against a tensile stress even under a vertical movement of the voice coil 22, thereby allowing the voice coil 22 to be driven smoothly. At the same time, this structure eliminates the possibility of breakage of the lead 22*a* caused by vibrations that may occur when the lead is connected to the contact 21*a* without the bent portion.

In addition, in the present embodiment, a difference in height in the axial direction of the voice coil 22 is provided between a height of the contact 21*a* and a height of a portion of the voice coil 22 from which the lead 22*a* is drawn out. A difference in height is further provided between a height of the contact 21*a* and a height of the bent portion 22*b*. The contact 21*a* is higher than the lead draw-out portion in the voice coil 22. This structure further provides the lead 22*a* a tolerance against the tensile stress under the vertical movement of the voice coil 22 and contributes to improve acoustic characteristics of the speaker. This improvement is due to improvement in the amplitudes of diaphragm 23, which is detailed hereinafter.

Furthermore, as shown in FIG. 2, the lead 22*a* is drawn out from a corner of the voice coil 22, bent in the vicinity of another corner, and then connected to the contact 21*a*. Thus, the lead 22*a* extends back and forth in a direction of the shorter side of the voice coil 22. This structure can easily secure the weight balance of the voice coil 22 in the direction of the shorter side. This is also effective in eliminating abnormal vibrations of the diaphragm 23. For this purpose, it is preferable to dispose the bent portion 22*b* in a position that is within the width of the shorter side of the voice coil and as far as possible from the lead draw-out portion.

The top end of the voice coil 22 is bonded to a center of the diaphragm 23. The periphery of the diaphragm 23 is bonded to the case 20 and the diaphragm covers the top opening of the case 20. A bonding of the voice coil and diaphragm, and a bonding of the diaphragm and case are performed by conventionally known means, such as adhesive bonding, ultrasonic bonding, and laser bonding.

With reference to FIG. 1(*a*), protector 24 has a plurality of holes 24*a*. The protector having damping cloth 24*b* bonded to the outer surface thereof is attached to the case 20 so as to cover the diaphragm 23.

The protector 24 protects the diaphragm 23 from external force, and the damping cloth 24*b* prevents excessive amplitudes of the diaphragm 23 at resonance.

The damping cloth 24*b* can be replaced by a plurality of holes drilled by laser irradiation instead of holes 24*a* through protector 24. In the conventional method, depending on various properties required for the speaker, the diaphragm 23 is changed according to the request. Thus, the damping cloth 24*b* is also changed according to a difference in the resonance frequency of the diaphragm during an assembling process of the speaker. However, if a process of drilling holes through the protector 24 using the laser irradiation is employed, the change in drilling conditions of the laser irradiation is enough to address the change of the diaphragm 23. This can contribute to improve productivity and to reduce the number of components. The holes can also be formed by means other than laser irradiation, such as machine drilling and electroforming.

A rectangular magnetic circuit 25 of the speaker of the present embodiment and a fitting of the magnetic circuit to the case are described next with reference to FIGS. 1 (*a*) to 5.

Figure 4:
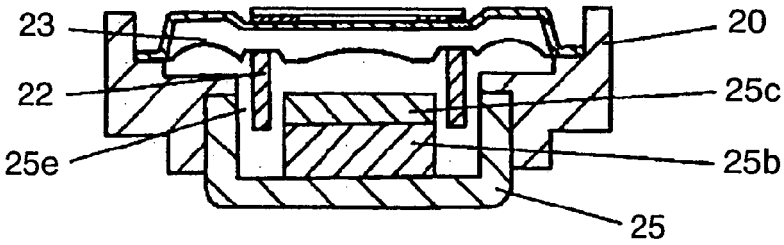
FIG. 4 is a sectional view of another speaker in accordance with the first exemplary embodiment of the present invention.

In the present embodiment, the magnetic circuit 25 is made by adhering rectangular magnet 25*b* and rectangular top plate 25*c* onto yoke 25*a* that has walls 25*d* formed by bending a sheet-like magnetic material. A magnetic gap 25*e* is provided between the top plate 25*c* and the walls 25*d*, into which the voice coil 22 is inserted. As shown in FIG. 4, magnetic circuit 25 is press fit into an opening on the bottom of the case 20, held therein, and fixed by an application of adhesive material.

Being shaped rectangular, the magnet 25*b* can occupy the largest volume in a limited space, thus can provide larger magnetic flux density than the conventional circular magnet. This prevents decrease in sound pressure caused by the decrease in the dimension of the speaker.

Figure 3:
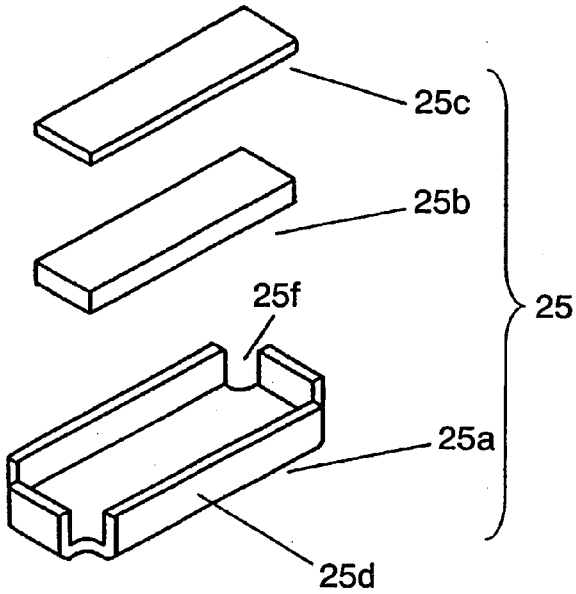
FIG. 3 is an exploded perspective view of a magnetic circuit of the speaker in accordance with the first exemplary embodiment of the present invention.

The yoke 25 shown in FIG. 3 is formed into a rectangular frame having a bottom. It is produced, first, by punching the outer shape of a sheet-like magnetic material, and then bending the punched sheet to provide four walls 25*d*. The walls 25*d* can be provided in more than four positions. In addition, a higher-performance magnetic circuit can be constructed by more than two bending steps. By using the yoke of the present embodiment, material loss can be reduced and productivity of the yoke 25 improves.

Figure 5:
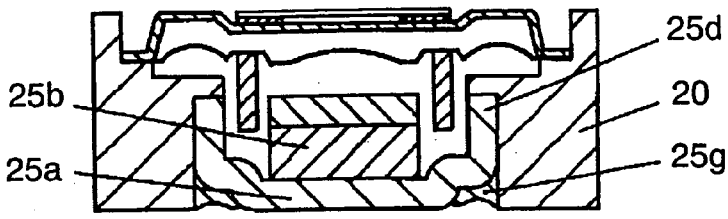
FIG. 5 is a sectional view of still another speaker in accordance with the first exemplary embodiment of the present invention.

As shown in FIG. 5, when recesses 25*g* are provided in bent portions of the walls 25*d* by two-shot forming, part of the adhesive accumulates in recesses 25*g*. This accumulation thickens the adhesive layer, thus enhancing the adhesive strength between the yoke 25 and the case 20.

Figure 6:
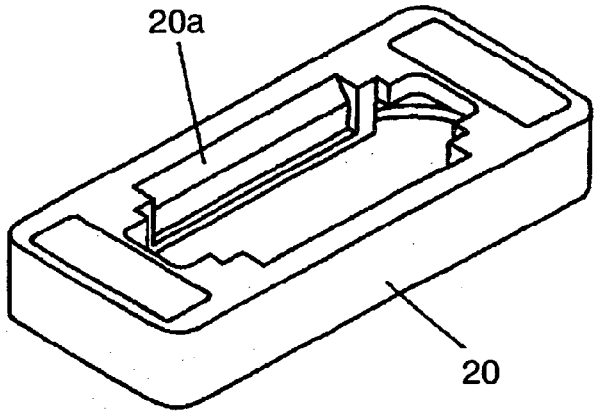
FIG. 6 is a perspective view of another case in accordance with the first exemplary embodiment of the present invention.
Figure 7:
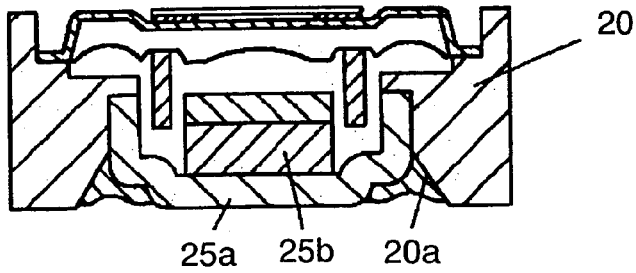
FIG. 7 is a sectional view of yet another speaker in accordance with the first exemplary embodiment of the present invention.

Furthermore, when recesses 20*a* are provided in portions in the case 20 to be joined with the yoke 25 as shown in FIG. 6, part of the adhesive accumulates in recesses 25*g* and recesses 20*a* as shown in FIG. 7. Thus, the adhesive strength can be further enhanced. The shape of the recesses 20*a* in the case 20 may be discontinuous steps as shown in FIG. 1 (*b*).

Figure 8:
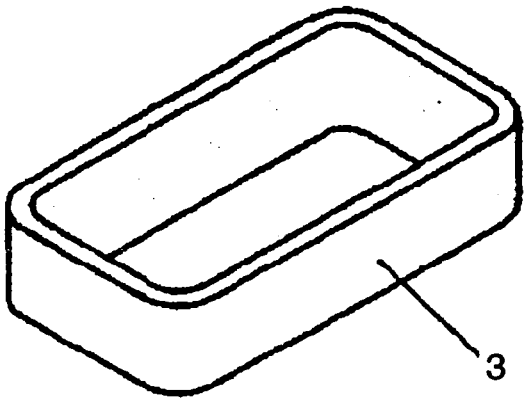
FIG. 8 is a perspective view of another yoke of the speaker in accordance with the present invention.

In the above description, a yoke formed by bending is mainly described. However, as means of constituting a rectangular magnetic circuit, a magnetic pipe material having a substantially rectangular cross section may be cut as the walls 25*d* and press fitted or welded to the bottom plate of the yoke, as shown in FIG. 8.

Further, the yoke 25*a* may be formed by a deep-drawing, though, it needs extra processes.

In the above explanation, the yoke 25*a* is described as being formed to have four faces by bending walls 25*d*. Even though the magnetic efficiency slightly decreases, the walls 25*d* on the shorter sides can be eliminated. In this case, the magnetic circuit 25 can be easily aligned when it is pressed into the case 20, thereby, the man-hour at assembling can be improved.

Next, the lead 22*a* is described with reference to FIG. 2.

As the walls 25*d* of the yoke 25*a* are formed by bending, the yoke 25 has a gap at each corner 25*f*. Thus, the magnetic gap 25*e* is open outwardly at each corner 25*f*. The lead 22*a* drawn out from a corner of the voice coil 22 is drawn out of the magnetic circuit 25 overlapping the corner 25*f*.

In other words, when it is drawn out from a vicinity of the bottom end of the voice coil 22, the lead 22*a* is drawn out of the magnetic circuit 25 through the corner 25*f*. In this case, the portion from which the lead 22*a* is drawn out is positioned so that the lead does not make contact with magnetic circuit 25. This configuration contributes to make the speaker thin.

When it is drawn out from a vicinity of a top end of the voice coil 22, the lead 22*a* is drawn out of magnetic circuit 25 from a space between the top end of the wall 25*d* and the diaphragm, as shown in FIG. 2. In this case, the lead draw-out position should be set so that the lead 22*a* does not make contact with the magnetic circuit 25 even at a largest amplitude of the voice coil 22. In each of the above-mentioned configurations, abnormal sound so-called a magnetic gap failure does not occur.

In the present embodiment, the voice coil 22 is described as having a shape already wound rectangular. However, the voice coil 22 may be wound around a rectangular protrusion of a lower die (not shown) that protrudes from the bottom opening of the case 20. In this case, after a heat seal layer on a surface of the voice coil 22 is heated and hardened, the voice coil is pulled out of the protrusion of the lower die and then joined to the diaphragm 23. This method prevents deformation of the voice coil 22 during transportation and eliminates troublesome handling of the voice coil, which is a work-in-process.

Second Exemplary Embodiment

The second exemplary embodiment of the present invention is described with reference to FIGS. 9 to 11. The components the same with those in the first embodiment have the same reference numerals, and the descriptions are omitted.

Figure 9:
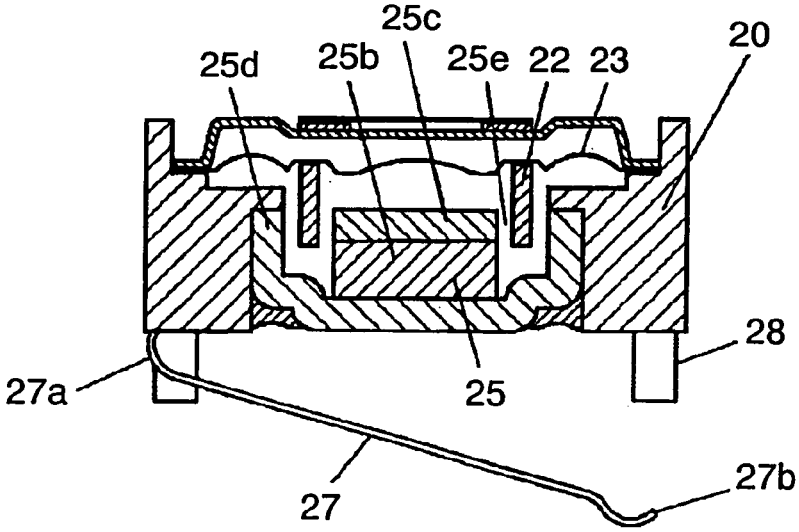
FIG. 9 is a sectional view of a speaker in accordance with a second exemplary embodiment of the present invention.

The speaker shown in FIG. 9 is similar to that of the first exemplary embodiment except that external connection terminals are made of spring 27 and each terminal is insert-molded in the case 20 at one end and is bent at portion 27*a*. Another end 27*b* of the spring terminal 27 comprises a power supply terminal so as not to exceed the outside dimension of the case 20. Another end 27*b* is slightly bent so that it is suitable as a contact member.

The speaker shown in FIG. 9 further includes protrusions 28 integrally molded with the case 20. The height of each protrusion 28 is set so that the spring terminal 27 does not exceed an elastic threshold at the bent portion 27*a* when the speaker of the present embodiment is installed in the equipment.

This structure allows the speaker to be installed in the equipment with proper spring pressure applied to the power supply section, even when the speaker is strongly depressed at the time of the installation. In other words, a stable contact can be obtained between the spring terminal 27 and the power supply section of the portable equipment because a strong spring pressure is maintained therebetween. For this reason, a stable contact can be maintained when the speaker is used for the portable equipment.

Figure 10:
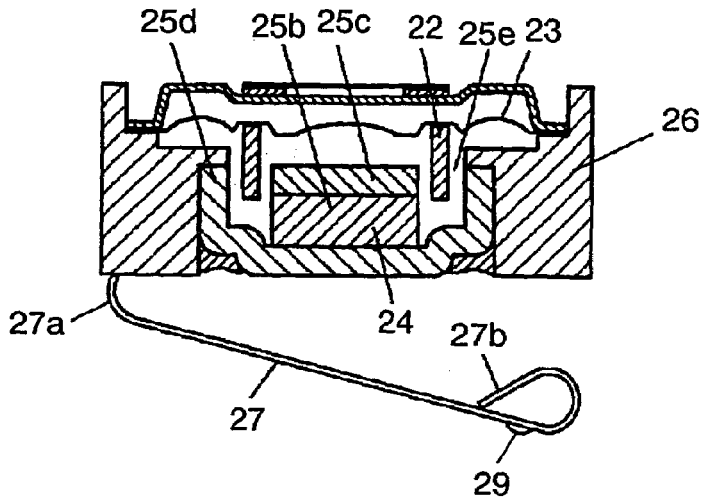
FIG. 10 is a sectional view of another speaker in accordance with the second exemplary embodiment of the present invention.

As a modification of the present embodiment, a spring terminal 27 having a structure shown in FIG. 10 can be used. In this modification, another end 27*b* is bent into a substantially round shape to form a stopper structure for preventing the bent portion of the spring from exceeding the elastic threshold, using the upper end of the round portion. This structure can provide an advantage of this modification, i.e. maintaining stable contact even without any protrusion provided on the case 20. When protrusion 29 is further formed in a portion where the spring terminal 27 is in contact with the power supply section, using gold, silver, copper, or alloys thereof, contact reliability is further improved.

Figure 11:
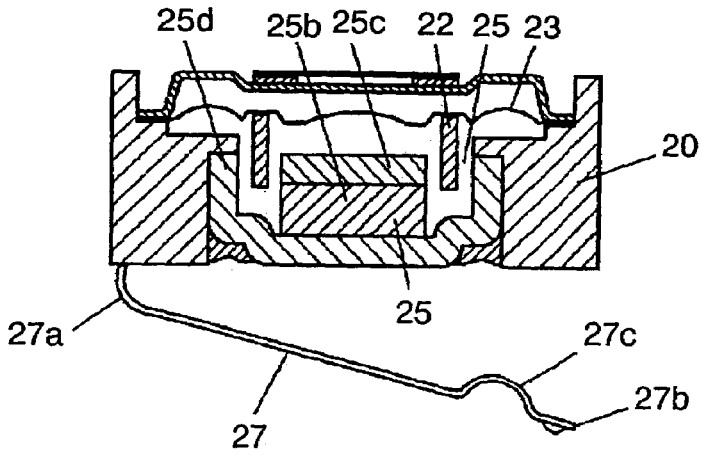
FIG. 11 is a sectional view of still another speaker in accordance with the second exemplary embodiment of the present invention.
Figure 12:
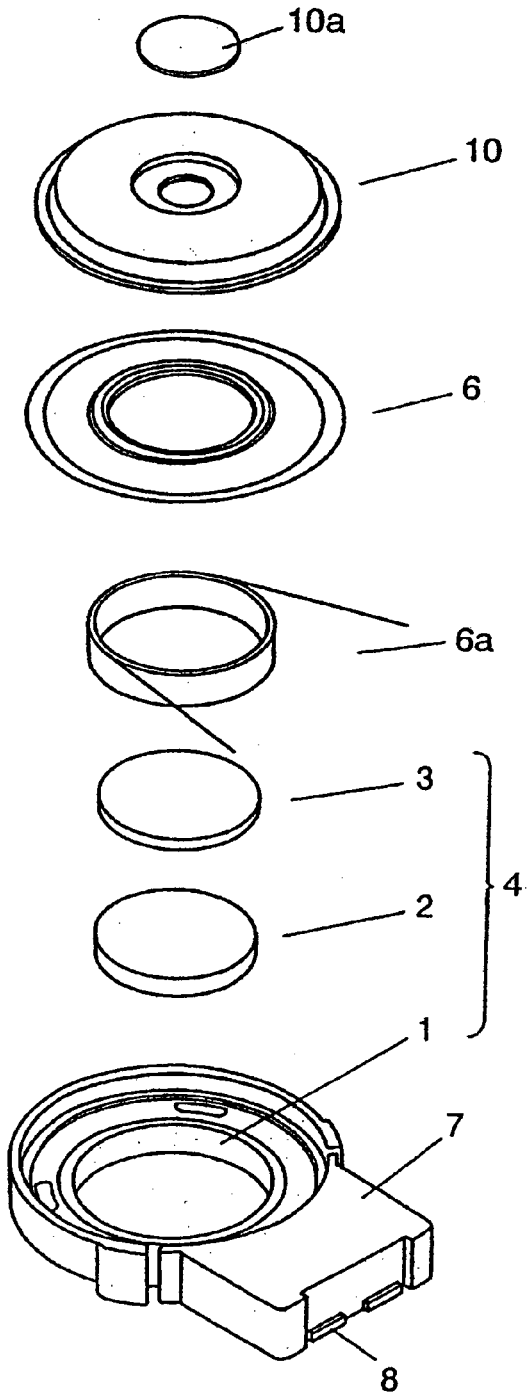
PRIOR ART FIG. 12
FIG. 12 is an exploded perspective view of a conventional speaker.
Figure 13:
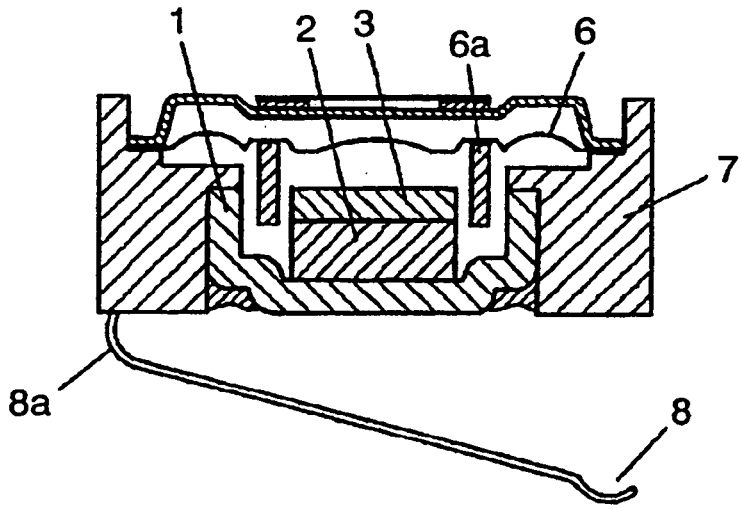
FIG. 13 PRIOR ART
FIG. 13 is a sectional view of the conventional speaker.

As another modification of the present embodiment, spring terminal 27 having a structure shown in FIG. 11 can be used. In this modification, portion 27*c* in the vicinity of another end of the spring terminal 27 is bent upwardly to form a stopper structure. Also in this modification, stable contact can be maintained.

INDUSTRIAL APPLICABILITY

As described above, the present invention can provide a speaker for use in portable equipment, such as a portable telephone, that can meet the requirements of space reduction without impairing characteristics, such as sound quality and sound pressure, and has excellent contact reliability of the terminal and reduced cost.

The invention claimed is:

1. A speaker comprising:

a substantially rectangular case having connection terminals at corners thereof;

a substantially rectangular voice coil having both ends electrically connected to said connection terminals;

a diaphragm joined to said voice coil and attached to said case; and a substantially rectangular magnetic circuit attached to said case, said magnetic circuit including a magnetic gap and comprising:

a yoke;

a magnet; and a plate, wherein a lead drawn out from a corner of said voice coil in proximity to one of the connection terminals extends to a vicinity of an another corner of a shorter side of said voice coil and connects to the connection terminal.

2. The speaker of claim 1, wherein said lead extends within a length of the shorter side of said voice coil.

3. The speaker of claim 2, wherein a shorter side of said substantially rectangular magnetic circuit is open to an outside, and said lead is drawn out from said shorter side of said substantially rectangular magnetic circuit to the outside.

4. The speaker of claim 1, wherein a difference in height in an axial direction of said voice coil is provided between a height of a lead draw-out portion of said voice coil and a height of the connection terminal.

5. The speaker of claim 4, wherein a shorter side of said substantially rectangular magnetic circuit is open to an outside, and said lead is drawn out from said shorter side of said substantially rectangular magnetic circuit to the outside.

6. The speaker of claim 1, further comprising a protector for covering said diaphragm.

7. The speaker of claim 6, wherein said protector has at least one hole and protecting cloth covering said hole.

8. The speaker of claim 7, wherein a shorter side of said substantially rectangular magnetic circuit is open to an outside, and said lead is drawn out from said shorter side of said substantially rectangular magnetic circuit to the outside.

9. The speaker of claim 6, wherein a shorter side of said substantially rectangular magnetic circuit is open to an outside, and said lead is drawn out from said shorter side of said substantially rectangular magnetic circuit to the outside.

10. The speaker of claim 1, wherein said yoke has at least one gap formed at one corner thereof.

11. The speaker of claim 10, wherein said lead is drawn out through said gap.

12. The speaker of claim 1, wherein at least one of said case and said yoke has a recess in a part thereof.

13. The speaker of claim 12, wherein said recess is filled with adhesive material.

14. The speaker of claim 1, wherein said connection terminals are integrally molded with said case.

15. The speaker of claim 1, further comprising external connection terminals made of an elastic material, and at least one protrusion provided on said case having said external connection terminals formed thereon.

16. The speaker of claim 15, further comprising protrusions made of one of gold, silver, copper and alloys thereof, said protrusions formed on said external connection terminals.

17. The speaker of claim 1, further comprising external connection terminals made of an elastic material, a vicinity of an end portion of each external connection terminal being bent toward said case.

18. The speaker of claim 17, further comprising protrusions made of one of gold, silver, copper and alloys thereof, said protrusions formed on said external connection terminals.

19. The speaker of claim 1, wherein a shorter side of said substantially rectangular magnetic circuit is open to an outside, and said lead is drawn out from said shorter side of said substantially rectangular magnetic circuit to the outside.

* * * * *